US007070179B1

(12) United States Patent
Bakker et al.

(10) Patent No.: US 7,070,179 B1
(45) Date of Patent: Jul. 4, 2006

(54) SYSTEM AND METHOD FOR FEEDING AND TRANSPORTING DOCUMENTS INCLUDING DOCUMENT TRAILING EDGE DETECTION BY SENSING AN AIR FLOW DISRUPTION WHILE THE DOCUMENT IS STILL BEING FED FROM THE DOCUMENT STACK

(75) Inventors: Johan P. Bakker, Brighton, MI (US); Jeremy J. Curcuri, Bloomfield Hills, MI (US)

(73) Assignee: Unisys Corporation, Blue Bell, PA (US)

( * ) Notice: Subject to any disclaimer, the term of this patent is extended or adjusted under 35 U.S.C. 154(b) by 225 days.

(21) Appl. No.: 10/329,865

(22) Filed: Dec. 26, 2002

(51) Int. Cl.
*B65H 1/18* (2006.01)

(52) U.S. Cl. ..... 271/153; 271/265.01; 271/90

(58) Field of Classification Search ..... 271/97, 271/90, 153, 265.01
See application file for complete search history.

(56) References Cited

U.S. PATENT DOCUMENTS 2,806,696 A * 9/1957 Bishop ..... 271/98
3,285,608 A * 11/1966 Lyman ..... 271/195
3,584,867 A * 6/1971 Cargill ..... 271/97
5,419,546 A 5/1995 Chen et al.
5,437,375 A 8/1995 Chen et al.
5,439,506 A 8/1995 Chen et al.
5,671,919 A 9/1997 Chen et al.
5,848,784 A 12/1998 Tranquilla
5,908,191 A 6/1999 Chen et al.
5,988,629 A * 11/1999 Burlew et al. ..... 271/152
6,086,064 A * 7/2000 Biegelsen et al. ..... 271/258.01
6,199,854 B1 3/2001 Tranquilla et al.

FOREIGN PATENT DOCUMENTS

JP 10194491 A * 7/1998

* cited by examiner

*Primary Examiner*—Patrick Mackey
(74) *Attorney, Agent, or Firm*—Lisa A. Rode; Mark T. Starr; Brooks Kushman P.C.

(57) ABSTRACT

A system and method for feeding and transporting documents are provided. The method includes directing airflow to a fixed location upstream of a feeder at a stack of documents such that a document trailing edge passing the fixed location causes a disruption in the airflow. The method further comprises sensing the airflow disruption to indicate detection of the document trailing edge at the fixed location. Various techniques may be utilized for sensing the airflow disruption including detecting air pressure variations, accelerations, and/or deflections that result from the disruption and airflow.

17 Claims, 6 Drawing Sheets

SYSTEM AND METHOD FOR FEEDING AND TRANSPORTING DOCUMENTS INCLUDING DOCUMENT TRAILING EDGE DETECTION BY SENSING AN AIR FLOW DISRUPTION WHILE THE DOCUMENT IS STILL BEING FED FROM THE DOCUMENT STACK

BACKGROUND OF THE INVENTION

1. Field of the Invention

The present invention relates to document feeders and document processing. More specifically, the present invention relates to systems and methods for detecting a document trailing edge during the feeding and transporting of documents.

2. Background Art

A typical system for feeding and transporting documents includes a feeder and a separator in the document-feeding portion of the system, and a series of roller pairs or belts in the document-transporting portion of the system. In the feeding portion of the system, the feeder acts with the separator to feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. The separator may be a wheel, but also may take other forms such as a belt. Further, the components in the transporting portion of the system may take a variety of forms. The systems also include a component in the document-feeding portion of the system that nudges documents into the nip between the feeder and the separator. A suitable nudger may be a nudger wheel, but may take other forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. U.S. Pat. Nos. 5,419,546, 5,437,375; 5,439,506; 5,509,648; 5,671,919; and 5,908,191 describe examples of other document operations.

Those skilled in the art will understand the importance of detecting the leading and trailing edges of documents, and the gaps between them, as they pass through the feeding system and the transport system beyond. Many operations to be performed upon the documents (e.g., printing, reading, imaging and so forth) are required to be performed at specific locations along the length of the document, and so it is very important for the system to be able to detect when the leading or trailing edge of a document appears at a specific point. From this data, the system can extrapolate its necessary understanding of where the document is, how fast it is traveling, and when and where specific operations should be performed upon it.

Similarly, it is just as important for the system to understand the lengths and locations of gaps between documents as it is for it to understand the lengths and locations of the documents themselves. It will be understood that document-processing systems seek to produce the highest possible throughput rates, and therefore, workers seek to minimize gaps between successive documents. At a given transport speed, a gap is a unit of time in the operation of the system which is not occupied by a document, and is therefore lost to productive processing. At the same time, systems often require a discrete and controlled time interval between documents, e.g., to transmit data gathered from the previous document, or to reset mechanisms after processing the previous document, and the optimum gap is usually dependent upon the length of the previous document. The longer the previous document (generally speaking) the longer the gap required after it before the system can be ready to commence processing the next document.

Operators therefore always seek to reduce the gaps between documents to the smallest possible consistent with all system functions, and for system functions, gaps are most usually dealt with as time measurements rather than measurements of physical distance. In order to best measure and manage both document lengths and the gaps between them for the optimum throughput, workers will understand that it is advantageous to be able to detect both leading and trailing edges of documents as early in their processing as possible, and preferably, during the feeding process, before any other processes are to be performed upon them.

Ideally, such a system would measure the position of the edges of the document in the feed hopper even before it is fed. However, documents can vary widely in overall length. For example, if one considers a high-speed document processing machine such as the commercially available Unisys NDP2000 (Unisys Corporation, Unisys Way, Blue Bell, Pa., 19424) the specified range of document length is 4.25"–9.25", or a range greater than 100% between the shortest and longest. In order to meet this need, a detector capable of detection over a wide possible range of document trailing edge positions would be required.

In order to perform operations on documents that depend on document position, leading and/or trailing document edges are detected depending on the operation to be performed. A known device for detecting document edges is the photo edge detector. U.S. Pat. No. 5,848,784 describes the use of an edge detector. The edge detector is suitable for some applications, but may be sensitive to, for example, printing on the documents and/or document thickness and/or opacity.

Those skilled in the art will understand that photo-edge detectors can be and are used to detect both leading and trailing edges of documents, but they can only function upon individual documents, e.g., when traveling singly in a document track. Since they rely for their function upon the interruption of a beam of light, they are unsuitable for use in a feed hopper that contains many documents. Such sensors have been used to detect leading edges of documents as they leave the stack in the feed hopper, but cannot be used to detect trailing edges until the trailing edge has entirely separated from the stack of documents behind it in the feed hopper.

For the foregoing reasons, there is a need for an improved system and method for feeding and transporting documents that detect a document trailing edge at a known location while it is still within the feed hopper.

SUMMARY OF THE INVENTION

It is, therefore, an object of the present invention to provide an improved system and method for feeding and transporting documents that detect, based on disruptions to the flow of pressurized air and the various detectable responses therefrom, a document trailing edge at a known location within a feed hopper, while the document whose trailing edge is to be detected is still in the process of being fed from the stack of documents behind it.

In order to meet this need, a detector capable of detection over a wide possible range of document trailing edge positions would be required. It is found that a single detector, at a suitable fixed location in the feed hopper consistent with the shortest possible document length, serves the desired function.

In carrying out the above object, a system for feeding and transporting documents is provided. Each document has a leading edge and a trailing edge. The system comprises a feeder stage, a transport stage, a pressurized air source, an airflow guide, and a sensor or sensors. The feeder stage includes a feeder and a separator. The feeder acts with the separator to feed documents singly, in order, from a stack of documents. The transport stage is downstream of the feeder stage for receiving the fed documents. The airflow guide is directed toward a fixed location upstream of the feeder at the stack of documents. The airflow guide defines a hollow cavity for accommodating airflow, and has an air inlet connected to the pressurized air source. The airflow guide further has an air outlet directed toward the stack of documents such that a document trailing edge passing the fixed location causes a disruption in the airflow through the hollow cavity. It is now possible to either sense the disruption in the airflow within the airflow guide caused by the passing of the trailing edge, or to detect deflection or other motion of the airflow guide in response to the disruption of airflow, or both.

In one embodiment, the airflow guide is pivotable relative to the stack of documents such that the disruption in airflow when the document trailing edge passes the fixed location causes the airflow guide to pivot. There are various options for the sensor, both single and multiple and/or additive. A pressure sensor located in the airflow path between the pressurized air source and the airflow guide air outlet will detect air pressure variations resulting from the disruption in airflow. An acceleration sensor affixed to the airflow guide will detect angular accelerations of the airflow guide resulting from the disruptions in airflow. Further, a preferred system includes a pressure sensor, an acceleration sensor, and diagnostic logic. The diagnostic logic is in communication with the pressure sensor and the acceleration sensor. The diagnostic logic is configured to determine a system relationship by comparing and contrasting air pressure variations to accelerations of the airflow guide. In this way, an edge detection signal of higher confidence may be obtained, for example, by configuring the system such that both an air pressure disruption and an angular acceleration response must be seen, in a range of known relationship to each other, in order that a "true" trailing edge signal is declared. Such configuration of multiple signal responses will produce a system that is more robust and immune to transient disruptions due to events such as vibration or ambient air pressure variation. Furthermore, the comparison may be used to estimate system losses. In such a situation, diminishing responsive accelerations to similar pressure stimuli may indicate excessive losses in the pivot or elsewhere, excessive friction in the pivot, or damage to the system.

In another embodiment, the airflow guide is fixed relative to the stack of documents such that the disruption in airflow when the document trailing edge passes the fixed location causes the airflow guide to deflect. In this embodiment there are also various options for the sensor, both single and multiple and/or additive. A pressure sensor located in the airflow path between the pressurized air source and the airflow guide air outlet will detect air pressure variations resulting from the disruption in airflow. A strain sensor affixed to the airflow guide will detect deflections of the airflow guide resulting from the disruptions in airflow. A preferred system includes a pressure sensor, a strain sensor, and diagnostic logic. The diagnostic logic is in communication with the pressure sensor and the strain sensor. The diagnostic logic is configured to determine a system relationship by comparing air pressure variations to deflections of the airflow guide. In this way, an edge detection signal of higher confidence may be obtained, for example, by configuring the system such that both an air pressure disruption and a deflection response must be seen in a known range of relationship to each other in order that a "true" trailing edge signal is declared. Such configuration of multiple signal responses will produce a system that is more robust and immune to transient disruptions due to vibration or ambient air pressure variation. For example, the comparison may be used to estimate system losses. In such a situation, diminishing responsive deflection to similar pressure stimuli may indicate excessive losses in the air pressure system, blockages, or damage to the system.

Further, in carrying out the present invention, a method for use in a system for feeding and transporting documents is provided. In the system for feeding and transporting documents, each document has a leading edge and a trailing edge. The system includes a feeder stage including a feeder and a separator. The feeder acts with the separator to feed documents singly, in order, from a stack of documents. A transport stage downstream of the feeder stage receives the fed documents. The method comprises directing airflow toward a fixed location upstream of the feeder at the stack of documents such that a document trailing edge passing the fixed location causes a disruption in the airflow. The method further comprises sensing the airflow disruption to indicate detection of the document trailing edge at the fixed location.

Sensing may be performed in various ways. Sensing may further comprise detecting air pressure variations resulting from the disruption in airflow. When the system further includes a pivotable airflow guide, sensing may further comprise detecting accelerations of the airflow guide resulting from the disruptions in airflow. When the system further includes an airflow guide that is fixed, sensing may further comprise detecting deflections of the airflow guide resulting from the disruptions in airflow. Some method embodiments may include determining a system relationship by comparing air pressure variations to accelerations (or deflections) of the airflow guide.

It is appreciated that systems and methods of the present invention nay utilize a wide variety of techniques to implement the sensor or perform sensing. Pressure detection techniques may detect air pressure at any location where pressure is affected by the airflow disruption caused by the document trailing edge passing the fixed location. Acceleration detection techniques may detect acceleration of any element that accelerates in response to the disruption in airflow caused by the document trailing edge passing the fixed location. Similarly, deflection detection based techniques may detect deflection of any element that deflects in response to the disruption in airflow caused by the document trailing edge passing the fixed location. That is, accelerations and/or deflections of the airflow guide may be used, and alternatively, accelerations and/or deflections of any other element positioned sufficiently within the vicinity of the fixed location to be affected by airflow disruptions caused by the document trailing edge passing the fixed location may be used.

The advantages associated with embodiments of the present invention are numerous. For example, embodiments of the present invention detect a document trailing edge at a known location by sensing a disruption in the outward flow of pressurized air. Embodiments of the present invention are suitable for use in a feed hopper. Detecting the trailing edge position while the document is still in the feeder allows operations to be performed on the document, as well as other operations to be performed while the document is still in the feeder. In addition, knowing the trailing edge position allows a system to know when to perform operations on subsequent documents. Many document processing products could benefit from embodiments of the present invention. For example, copiers, fax machines, sheet feeders for computer printers, automatic teller machines, and document image scanners are just a few examples of products that could benefit from embodiments of the present invention.

The above object and other objects, features, and advantages of the present invention are readily apparent from the following detailed description of the preferred embodiments when taken in connection with the accompanying drawings.

DETAILED DESCRIPTION OF THE PREFERRED EMBODIMENTS

Figure 1:
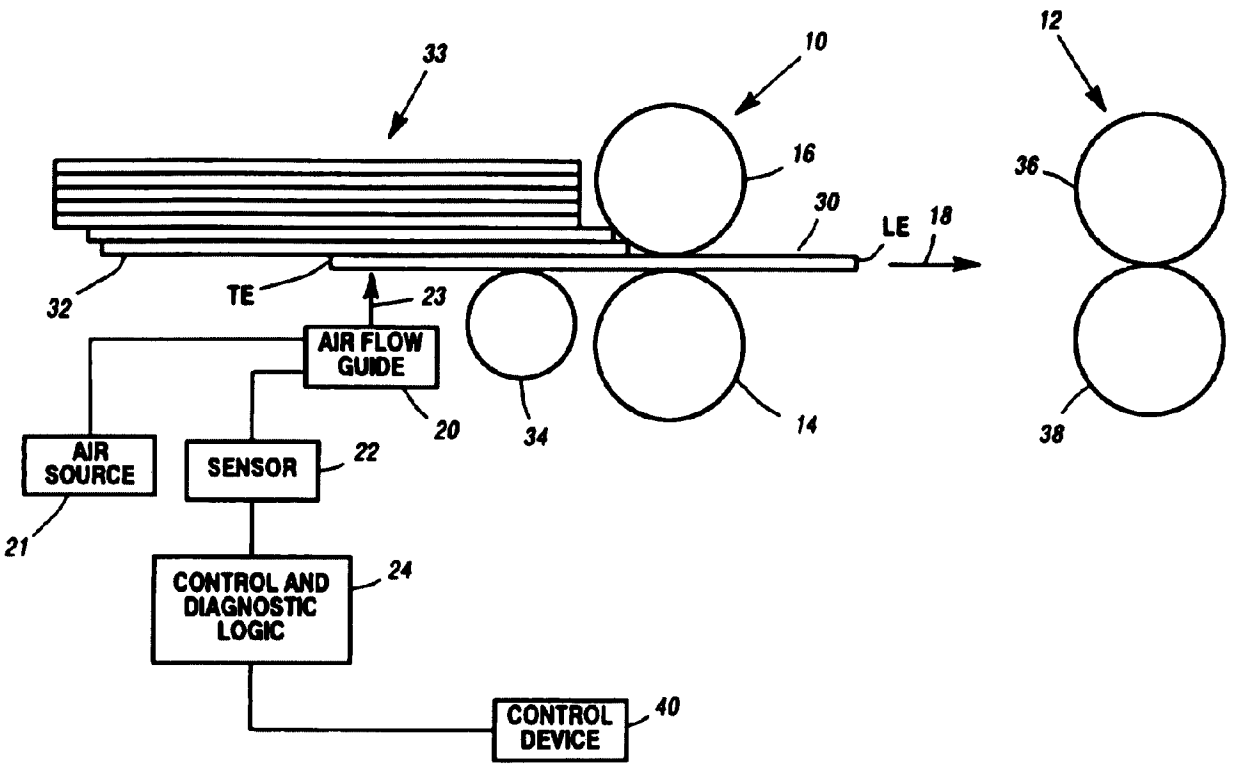
FIG. 1 illustrates an exemplary system for feeding and transporting documents in accordance with the present invention.

FIG. 1 illustrates a system for feeding and transporting documents. The system includes a feeder stage 10 and a transport stage 12. Feeder stage 10 includes a feeder 14 and a separator 16. Transport stage 12 is downstream of feeder stage 10, with arrow 18 pointing in the downstream direction. A document leading edge LE is the more downstream edge while the trailing edge TE is the more upstream edge. An airflow guide 20 is directed toward a fixed location 23 upstream of feeder 14 at the stack 33 of documents. Airflow guide 20 defines a hollow cavity for accommodating airflow, and has an air inlet connected to a pressurized air source 21. Airflow guide 20 further has an air outlet directed toward the stack 33 of documents such that a document trailing edge TE passing the fixed location 23 causes a disruption in airflow through the hollow cavity of airflow guide 20. A sensor 22 produces a signal responsive to the airflow disruption to indicate detection of the document trailing edge TE at the fixed location 23. Sensor 22 provides an output to control and diagnostic logic 24.

Control and diagnostic logic 24 is configured to detect the signal from sensor 22 indicating when a document trailing edge TE passes the fixed location 23. Control and diagnostic logic 24 also provides an output signal, which is provided to a control device 40. Control and diagnostic logic 24 may direct control device 40 to perform document-processing functions based on knowledge of the trailing edge position. Further, control and diagnostic logic 24 may perform system diagnostics based on received signals.

The document stack 33 is shown adjacent to separator 16 and includes the first document 30 and second document 32 among other documents in stack 33, with the trailing edge of first document 30 being near fixed location 23. The components shown in FIG. 1 are preferred, and alternative arrangements are possible as known to those skilled in the art. For example, the feeder is shown as a feed wheel 14, but may take other forms. The separator is shown as a separator wheel 16, but also may take other forms such as a belt. As shown, feed wheel 14 rotates clockwise, driven by its own motor (not shown), and separator or retarder wheel 16 is fixed or runs slowly relative to the speed of the feed wheel. Further, the components in transporting portion 12 may take a variety of forms as known to those skilled in the art, but for convenience of understanding are shown as an accelerator idler wheel 36 and an accelerator drive wheel 38 that rotates clockwise. In a preferred embodiment, the system includes a suitable nudging device such as nudger wheel 34.

The system shown in FIG. 1 detects, or registers the presence or arrival of, trailing edge TE of document 30 at a known location based upon the flow of pressurized air. Detecting the trailing edge of a moving document while still in the feed hopper has many advantages. For example, using any appropriate technique known in the art, the total length of the document may be determined earlier in the feeding cycle, thus allowing various other document processing functions to be performed upon the document sooner, faster, and/or at lower cost.

Figure 2:
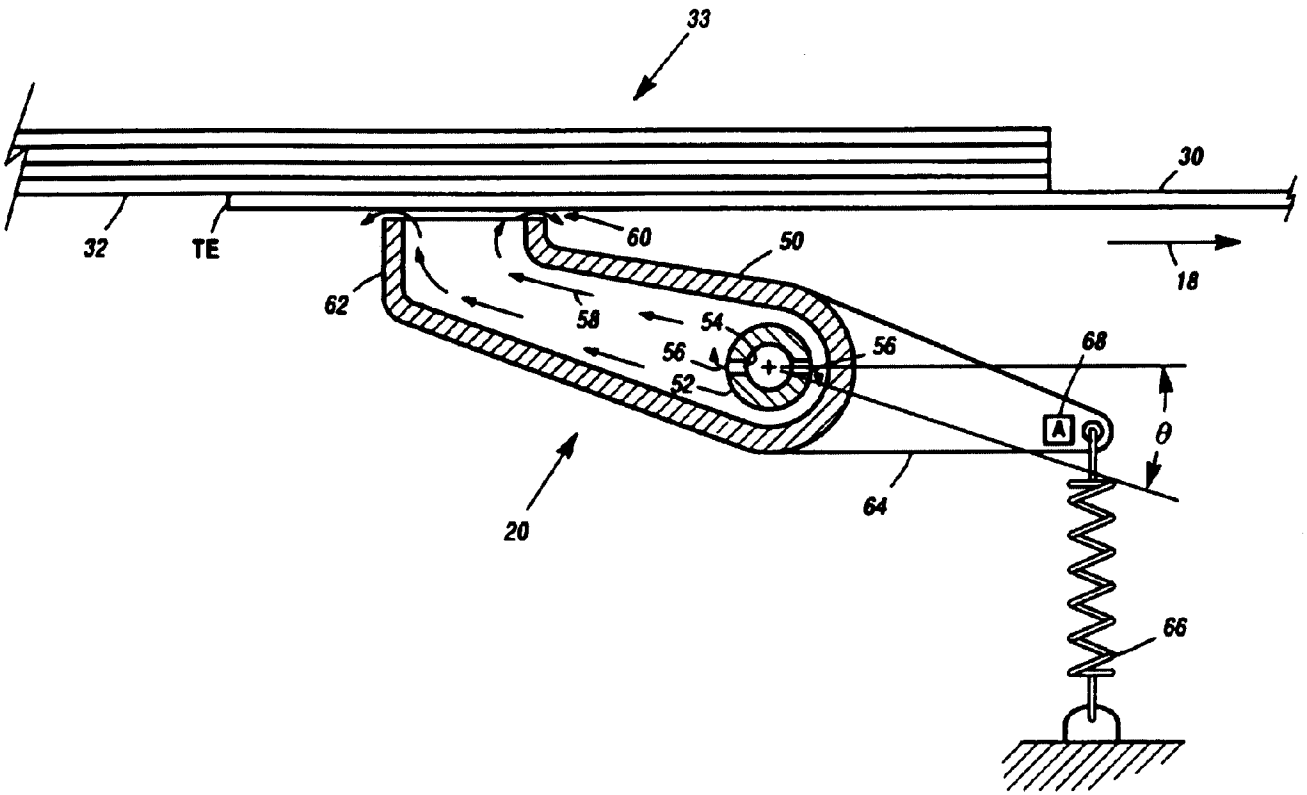
FIG. 2 illustrates a plan view partially in cross-section of a system embodiment utilizing a pivotable airflow guide, showing the condition when an item is being fed past the sensor but the trailing edge has not yet arrived at the sensor.

FIG. 2 illustrates a system embodiment of the present invention wherein the airflow guide 20 is implemented as a hollow pivoting arm 50. One end 62 of arm 50 provides a flat surface with an opening 60 into the hollow cavity of arm 50, and is shaped and located to conform to the face of the stack 33 of items to be fed Arm 50 is so constructed and located, and opening 60 is so formed and constructed, that document 30 on the face of the stack 33 completely covers and overlaps the entire area of opening 60. The other end 64 of arm 50 is provided with a extension spring 66 Arm 50 is pivoted approximately about its center, and pivot element 52 is also hollow and provided with radial ports 54 which open into the hollow cavity inside arm 50 as is discussed in more detail with respect to FIGS. 4 and 5. Air under pressure is applied to pivot element 52 and flows through its hollow center, out through the radial ports 54, and into the hollow cavity of arm 50 as indicated by arrows 56 The supply of pressurized air is provided by an appropriate compressor and filters and controlled by a pressure regulator of conventional type (see below with reference to FIG. 5). Accordingly, a flow of air from a constant pressure source can be provided that is not affected by variations in the compressor, filters, and so forth.

Figure 3:
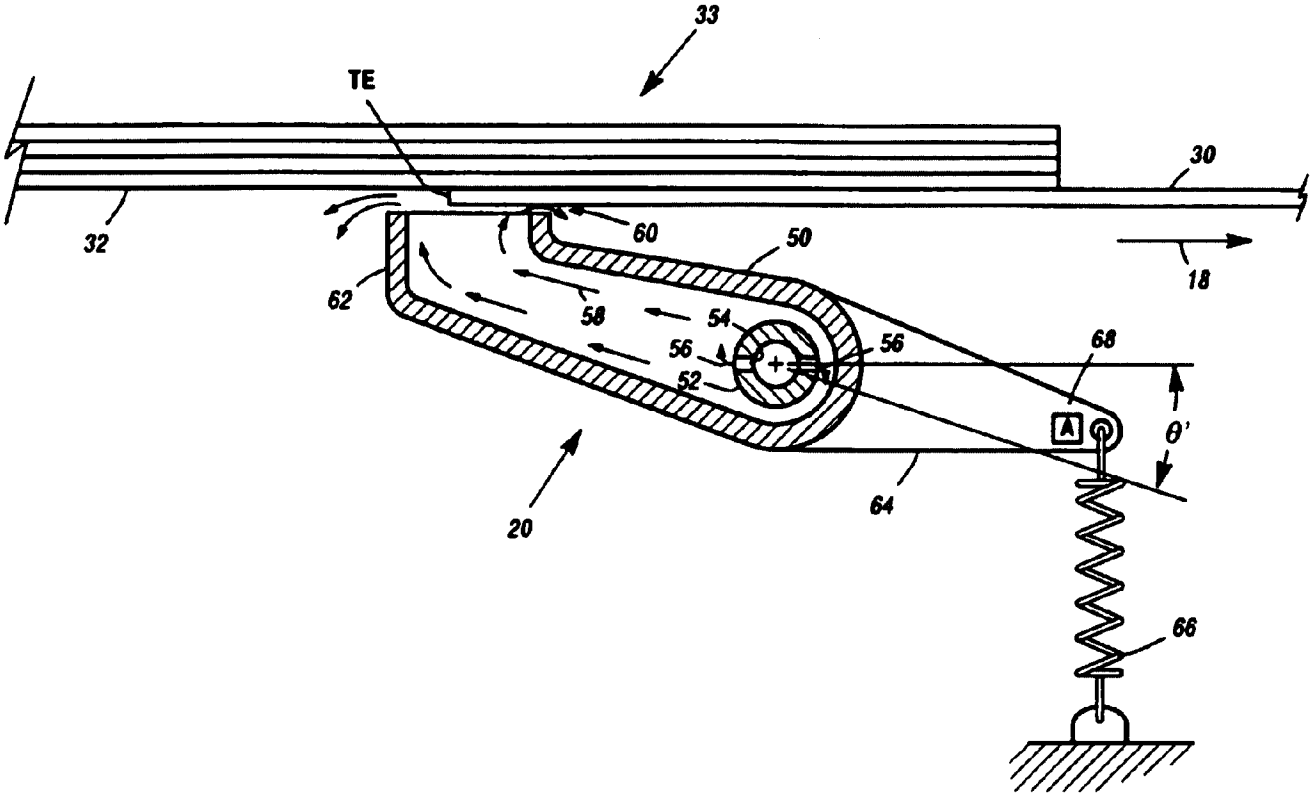
FIG. 3 illustrates a plan view partially in cross-section of the FIG. 2 embodiment, but at the condition where the trailing edge of the item being fed has arrived at the sensor.

Considering a first item 30 being fed from the feeder, the flat surface of pivoting arm 50 which contains opening 60 into the hollow cavity of arm 50 rides near the surface of item or document 30. Air under pressure travels as described to end 62 of arm 50, where the air leaks out between the end 62 of pivoting arm 50 and the face of document 30. The air will leak relatively evenly at all points around the opening in the illustrated implementation, and the effect will be to cause the flat surface of the arm 50 to float a very small distance from the surface of the document, supported on the cushion of leaking air. Spring 66 on other end 64 of pivoting arm 50 urges open end 62 of arm 50 to pivot towards the face of items being fed, but is opposed by the force due to the pressure of the air within arm 50 which leaks out against the face of document 30 around the periphery of opening 60. As shown in FIG. 2, arm 50 is at an equilibrium, balanced between the force of spring 66 on end 64 and the force of the air within arm 50 leaking out around the periphery of opening 60. Air pressure inside the air delivery system may be measured by a conventional sensor (not shown) located at a suitable point such as between the air pressure regulator and the pivoting arm mechanism. Similarly, rotational accelerations of arm 50 may be measured by a conventional acceleration sensor (not shown) located at a suitable point along airflow guide 20, for example, at 68. When the equilibrium of arm 50 is disturbed by a disruption in the airflow out of opening 60, such as when a trailing edge causes a change in the airflow pressure throughout the system changes. These pressure changes result in pivoting of arm 50 until the force of spring 66 and force due to air pressure are again balanced. This may be better understood with reference to FIG. 3.

As seen therein, as the document 30 is fed from the feeder, the trailer edge TE of document 30 will eventually pass through the area where the flat surface of the pivoted arm 50 is floating against the item surface. The effect of this will be that of a step, equivalent in height in the thickness of the document 30, passing in front of the flat surface of arm 50. As the "step" passes, the cushion of air on which arm 50 is floating will be disrupted. As the trailing edge of document 30 passes in front of opening 60, the effective gap through which air leaks around the periphery of opening 60 (as described previously) will suddenly enlarge. Since the supply airflow is constant and regulated, the air pressure in the immediate vicinity of opening 60 will fall, and this lower-pressure effect will propagate within the hollow cavity of arm 50, back through air ports 54 and the hollow center of pivot 52, and thereafter through the associated tubing towards air source 21. The overall effect is that of a "pulse" of lowered pressure that passes through the entire airflow supply system, and it is this "pulse" of lowered pressure passing through the airflow supply system, which is detected by the pressure sensor. Furthermore, in response to the change in pressure, the equilibrium of forces between the pressurized air leaking out at opening 60 and the tension of spring 66 will be disrupted, and arm 50 will begin to pivot in a clockwise direction from angle θ shown in FIG. 2 to angle θ' shown in FIG. 3). As arm 50 pivots, and as the effective "step" formed by the trailing edge of document 30 passes opening 60, the pressure inside arm 50 increases as the gap between the face of the subsequent document 32 and the opening 60 becomes both constant and reducing, and pressure again builds inside the hollow cavity. At the same time, the force asserted by spring 66 is slightly decreased as arm 50 pivots. This combination of the restoring air pressure and the restoring force of spring 66 combines to restore pivoting arm 50 to the same condition of force equilibrium that it was in before the trailing edge of document 30 began to pass before opening 60. Acceleration sensor 68, if provided, will sense rotational accelerations of arm 50 as arm 50 pivots through the cycle described. As mentioned previously, the air pressure sensor and/or an acceleration sensor may be used to detect the passing trailing edge, and it will be appreciated that multiple sensors provide redundancy, as well as diagnostic capability.

Either or both of the output sensor signals are then sent to control and diagnostic logic 24 to indicate that the trailing edge has passed. As discussed above, control and diagnostic logic 24 may direct control device 40 to perform document-processing functions based on knowledge of the trailing edge position. Once the trailing edge TE has passed, the pivoting equilibrium of the sensing arm will be re-established against the face of the next document 32 in the stack, and the equilibrium of air pressure inside the hollow cavity and inside the arm 50 will be likewise re-established.

Figure 4:
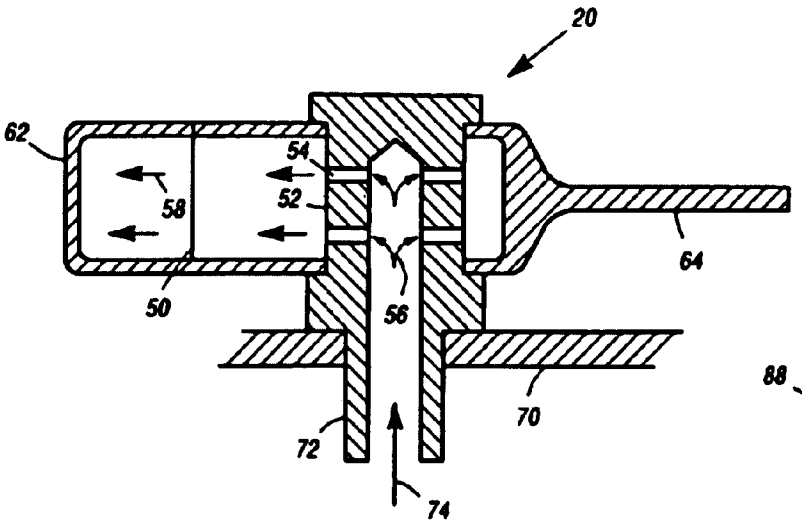
FIG. 4 illustrates an elevation view partially in cross-section of the FIG. 2 embodiment.

FIG. 4 shows an elevation view of the airflow guide 20 that is again composed of arm 50 and pivot element 52. Also shown in FIG. 4 is the construction of pivot element 52, which consists of a hollow center cavity 74 with multiple radial airflow ports 56. As discussed above, the flow of pressurized air is supplied to the hollow center cavity by conventional air hose means (not shown)) and flows up through cavity 74, out through radial ports 56, and into the hollow cavity of arm 50. Pivot element 52 is further attached by conventional fastener means to a solid mounting element 70 of the machine frame.

Figure 5:
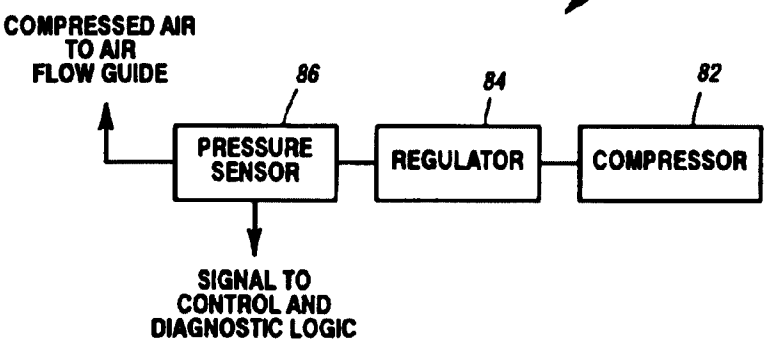
FIG. 5 illustrates a simplified schematic of the air supply and logic connections associated with the sensor in the FIG. 2 embodiment.

FIG. 5 illustrates a schematic of the air supply and logic connections associated with the system. More specifically, compressor 82 provides pressurized air to regulator 84. Pressure sensor 86 is downstream of regulator 84 such that pressure variations passing through the system are detected by air pressure sensor 86. Alternatively, acceleration sensor 88 detects rotational accelerations of the pivoting airflow guide that occur in response to airflow disruptions, as described above. As mentioned previously, in embodiments that utilize the pivoting airflow guide, either the pressure sensor 86 or the acceleration sensor 88 or both sensors may be used. When both sensors are used, the relationship between the sensor outputs may be used to estimate losses or to detect excessive losses in the pivot to anticipate failure. In a correctly functioning system, a typical profile of both sensor responses to a conventional trailing-edge passing at the correct speed may be produced and stored in the control logic 24, and all subsequent sensor responses compared with it. If, for example, it is seen that the response of the acceleration sensor has a longer period than the stored reference, but the air-pressure sensor response remains the same as the reference, it may be deduced that some frictional loss has accumulated in the system, and a service attention can be signaled. If, for another example, the air pressure response or steady-state value begins to deviate from the stored reference, a leak or blockage of the airflow supply system may be suspected, and a service attention signaled. Use of both sensors may also provide redundancy.

Figure 6:
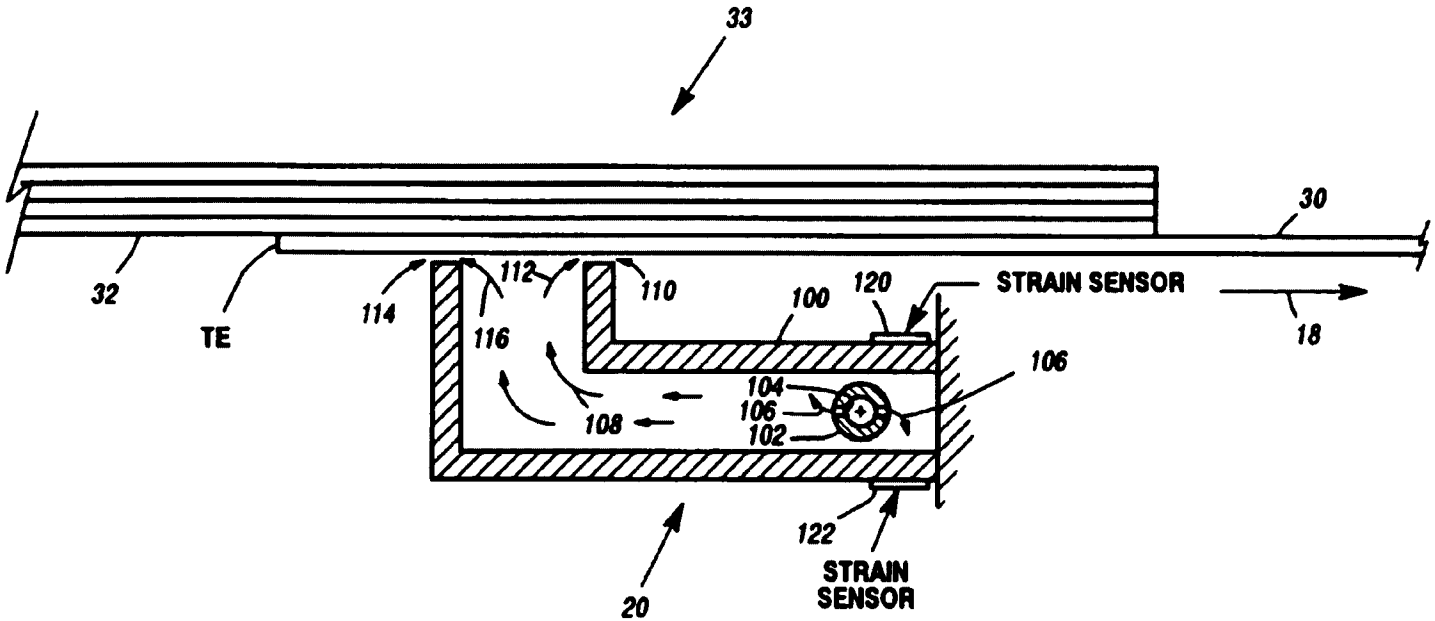
FIG. 6 illustrates a plan view partially in cross-section of a system embodiment utilizing a fixed airflow guide, showing the condition when an item is being fed past the sensor but the trailing edge has not yet arrived at the sensor.

FIG. 6 illustrates an alternate embodiment of the fixed airflow guide of the present invention. More particularly, it will be understood that in applications where the documents being fed are so constrained and supported that their location relative to end of the airflow guide is relatively well-controlled, and the documents themselves are always flat, smooth and otherwise in good condition, a non-pivoting system may be used. Thus, as shown in FIG. 6, arm 100 is fixed at its closed end to some adjacent, solid mounting (not described). Air flows into the arm through inlet 102 and ports 104 to provide uniform flow as indicated by arrows 106 and 108 through arm 1100. Pressurized air flows out of gap 110 as indicated by arrow 112, and out of gap 114 as indicated by arrow 116, and in this condition, the force exerted by the pressurized air flowing out against the face of document 30 causes a deflection of arm 100 away from the document face. In this embodiment, as the trailing edge TE of document 30 passes gaps 110 and 114, the disruption in airflow through the hollow cavity causes a change in the force which tends to deflect the airflow guide, and a resultant change in the deflection of the airflow guide. One or more strain sensors 120 and 122 detect deflection in the airflow guide caused by the airflow disruption that occurs when trailing edge TE passes gaps 110 and 114. The non-pivoting embodiment of FIG. 6 may also utilize a pressure sensor at any suitable location within the air system instead of one or more strain sensors, or may utilize both a pressure sensor and one or more strain sensors. Using both sensor types has the added benefit of providing redundancy as well as of detecting changes in elasticity and/or permanent deformation to anticipate failure.

Figure 7:
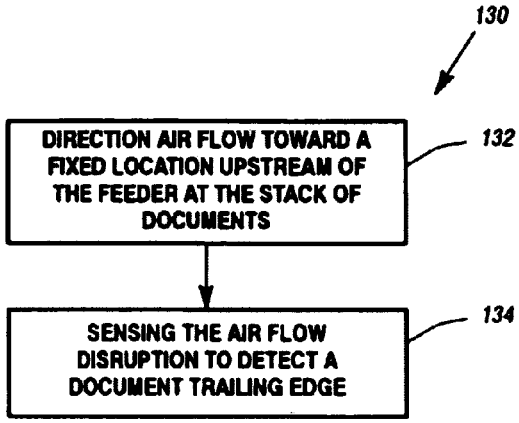
FIG. 7 is a block diagram illustrating a method in accordance with the present invention.

FIG. 7 illustrates generally at 130, one embodiment of a method of the present invention. At block 132, airflow is directed to a predetermined location at the stack of documents upstream of the document feeder. At block 134, an airflow disruption is sensed to detect a document trailing edge TE such airflow disruption being sensed in at least one of a number of the various ways described in more detail above. These airflow disruptions are then preferably compared to either accelerations of the pivoting airflow guide as described in more detail in FIG. 8, or to deflections of the airflow guide as described in more detail in FIG. 9.

Figure 8:
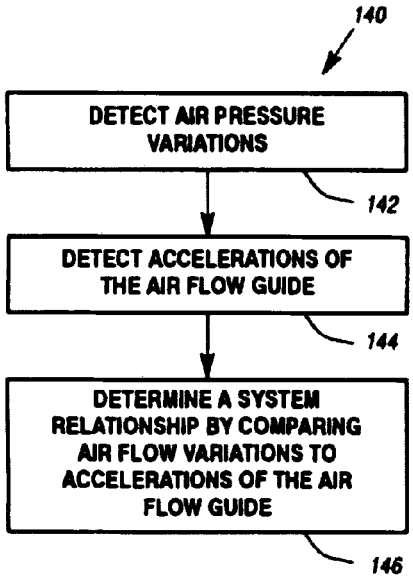
FIG. 8 is a block diagram illustrating a method embodiment where a system relationship is determined by comparing airflow variations to accelerations of the airflow guide; and, FIG. 9 is a block diagram illustrating a method embodiment where a system relationship is determined by comparing airflow variations to deflections of the airflow guide.

More specifically, and with reference to FIG. 8, an embodiment of a method of the invention 140 is shown where a system relationship is determined by comparing airflow variations determined as discussed above to accelerations of the pivoting airflow guide. Air pressure variations are detected, at block 142 and accelerations of the airflow guide are detected at block 144. The system relationship is then is determined at block 146 by comparing airflow variations to accelerations of the airflow guide.

Figure 9:
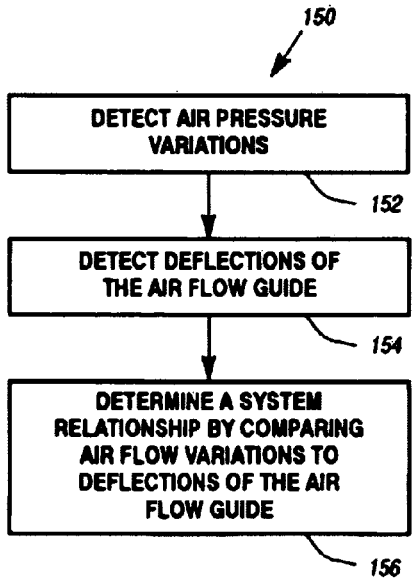

FIG. 9 illustrates yet another embodiment of a method of the present invention at 150. Air pressure variations are detected at block 152, after which deflections of the airflow guide are detected (block 154). Finally, at block 156, the system relationship is then determined by comparing airflow variations to deflections of the airflow guide.

It is appreciated by those skilled in the art that embodiments of the present invention may be applied in multiple locations upon the same item. For example, the system could be applied at various points in the height of the item being fed to obtain a reliable signal of the trailing edge that is not affected by the presence of holes or tears in item. By way of example, financial documents are especially prone to tears and holes as some documents (e.g., batch tickets and batch headers) have holes punched into them specifically for use with the document detection systems of certain other manufacturers. Holes and tears can create havoc in a detection system, since they appear as "false" leading and/or trailing edges and give the appearance (to the system) of being two separate documents traveling very close together, rather than one single document with a hole in it. For this reason, multiple sensors at various heights are sometimes used, to give a more-reliable signal, since holes and tears are generally localized.

The system could also be applied at various points along the length of the item to give sequential signals of the trailing edge of the item that could be used to calculate the speed of the item. For example, financial documents can vary widely in length (from 4.125 inches to 9.25 inches in the USA, and longer in other parts of the world) and may be fed in any combination. If the length of a document is known, then the speed may be calculated from the position of the sensor relative to the feed apparatus, in conjunction with the first sensor downstream of the feed apparatus. However, if the length of the document is not known, its speed cannot be calculated solely from leading edge (LE) and trailing edge (TE) detection. Two detections of the same feature (LE or TE) are required. As discussed earlier, since it is desirable for the speed to be known as soon as possible, the earliest possible speed detection would be to have two TE sensors prior to the feed apparatus.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for feeding and transporting documents, each document having a leading edge and a trailing edge, the system comprising:

a feeder stage including a feeder and a separator wherein the feeder acts with the separator to feed documents singly, in order, from a stack of documents;

a transport stage downstream of the feeder stage for receiving the fed documents;

a pressurized air source;

an air flow guide directed toward a fixed location upstream of the feeder at the stack of documents, the air flow guide defining a hollow cavity for accommodating air flow, having an air inlet connected to the pressurized air source, and having an air outlet directed toward the stack of documents such that a document trailing edge passing the fixed location causes a disruption in the air flow through the hollow cavity; and a sensor producing a signal indicative of the air flow disruption to indicate detection of the document trailing edge at the fixed location wherein the sensor is located to sense the air flow disruption through the hollow cavity while the document is still being fed from the document stack.

2. The system of claim 1 wherein the air flow guide is pivotable relative to the stack of documents such that the disruption in air flow when the document trailing edge passes the fixed location causes the air flow guide to pivot.

3. The system of claim 2 wherein the sensor is a pressure sensor located in the air flow path between the pressurized air source and the air flow guide air outlet to detect air pressure variations resulting from the disruption in air flow.

4. The system of claim 2 wherein the sensor is an acceleration sensor affixed to the air flow guide to detect accelerations of the air flow guide resulting from the disruptions in air flow.

5. The system of claim 2 wherein the sensor comprises:

a pressure sensor located in the air flow path between the pressurized air source and the air flow guide air outlet to detect air pressure variations resulting from the disruption in air flow; and an acceleration sensor affixed to the air flow guide to detect accelerations of the air flow guide resulting from the disruptions in air flow.

6. The system of claim 5 further comprising:

diagnostic logic in communication with the pressure sensor and the acceleration sensor, the diagnostic logic being configured to determine a system relationship by comparing air pressure variations to accelerations of the air flow guide.

7. The system of claim 1 wherein the air flow guide is fixed relative to the stack of documents such that the disruption in air flow when the document trailing edge passes the fixed location causes the air flow guide to deflect.

8. The system of claim 7 wherein the sensor is a pressure sensor located in the air flow path between the pressurized air source and the air flow guide air outlet to detect air pressure variations resulting from the disruption in air flow.

9. The system of claim 7 wherein the sensor is a strain sensor affixed to the air flow guide to detect deflections of the air flow guide resulting from the disruptions in air flow.

10. The system of claim 7 wherein the sensor comprises:

a pressure sensor located in the air flow path between the pressurized air source and the air flow guide air outlet to detect air pressure variations resulting from the disruption in air flow; and a strain sensor affixed to the air flow guide to detect deflections of the air flow guide resulting from the disruptions in air flow.

11. The system of claim 10 further comprising:

diagnostic logic in communication with the pressure sensor and the strain sensor, the diagnostic logic being configured to determine a system relationship by comparing air pressure variations to deflections of the air flow guide.

12. In a system for feeding and transporting documents, each document having a leading edge and a trailing edge, the system including a feeder stage including a feeder and a separator wherein the feeder acts with the separator to feed documents singly, in order, from a stack of documents, and a transport stage downstream of the feeder stage for receiving the fed documents, the method comprising:

directing air flow toward a fixed location upstream of the feeder at the stack of documents such that a document trailing edge passing the fixed location causes a disruption in the air flow; and sensing the air flow disruption to indicate detection of the document trailing edge at the fixed location wherein the sensing location is located to sense the air flow disruption while the document is still being fed from the document stack.

13. The method of claim 12 wherein sensing further comprises:

detecting air pressure variations resulting from the disruption in air flow.

14. The method of claim 12 wherein the system further includes a pivotable air flow guide, and wherein sensing further comprises:

detecting accelerations of the air flow guide resulting from the disruptions in air flow.

15. The method of claim 12 wherein the system further includes a pivotable air flow guide, and wherein sensing further comprises:

detecting air pressure variations resulting from the disruption in air flow;

detecting accelerations of the air flow guide resulting from the disruptions in air flow; and determining a system relationship by comparing air pressure variations to accelerations of the air flow guide.

16. The method of claim 12 wherein the system further includes an air flow guide and wherein sensing further comprises:

detecting deflections of the air flow guide resulting from the disruptions in air flow.

17. The method of claim 12 further comprising:

detecting air pressure variations resulting from the disruption in air flow;

detecting deflections of the air flow guide resulting from the disruptions in air flow; and determining a system relationship by comparing air pressure variations to accelerations of the air flow guide.

* * * * *